United States Patent [19]

Katz

[11] Patent Number: 4,533,789

[45] Date of Patent: Aug. 6, 1985

[54] HIGH VOLTAGE ELECTRIC POWER CABLE WITH THERMAL EXPANSION ACCOMMODATION

[75] Inventor: Carlos Katz, Edison, N.J.

[73] Assignee: Cable Technology Laboratories, Inc., New Brunswick, N.J.

[21] Appl. No.: 647,878

[22] Filed: Sep. 6, 1984

Related U.S. Application Data

[63] Continuation of Ser. No. 465,802, Feb. 11, 1983, abandoned.

[51] Int. Cl.[3] ..... H01B 7/18

[52] U.S. Cl. ..... 174/102 R; 174/13; 174/105 SC; 174/106 SC

[58] Field of Search ..... 174/13, 102 R, 105 R, 174/105 SC, 106 SC, 107

[56] References Cited

U.S. PATENT DOCUMENTS

| | | | |
|---|---|---|---|
| 1,939,875 | 12/1933 | Bush | 174/13 |
| 2,011,561 | 8/1935 | Chase | 174/13 |
| 2,118,584 | 5/1938 | Aime | 174/13 |
| 3,719,769 | 3/1973 | Miyauchi et al. | 174/105 SC X |
| 3,964,945 | 6/1976 | Everhart et al. | 174/107 X |
| 4,145,567 | 3/1979 | Bahder et al. | 174/107 |
| 4,225,749 | 9/1980 | Pierre et al. | 174/105 SC |

FOREIGN PATENT DOCUMENTS

| | | | |
|---|---|---|---|
| 695124 | 7/1940 | Fed. Rep. of Germany | 174/105 |
| 2008533 | 8/1971 | Fed. Rep. of Germany | 174/107 |
| 857924 | 10/1940 | France | 174/13 |

*Primary Examiner*—A. T. Grimley
*Assistant Examiner*—Morris H. Nimmo
*Attorney, Agent, or Firm*—Hopgood, Calimafde, Kalil, Blaustein & Judlowe

[57] ABSTRACT

The insulation shield in a power cable having thick polymeric insulation is constructed of a metallic layer radially spaced from but in electrical communication with an inner semiconducting layer by an intervening helical wrap of a semiconducting or high dielectric constant longitudinal structurally resiliently compressible substantially shape recoverable element. Various elements are described, both hollow and solid, with and without one flat longitudinal surface, and of both monolithic plastic and composite plastic and metal construction.

18 Claims, 24 Drawing Figures

Fig. 1.
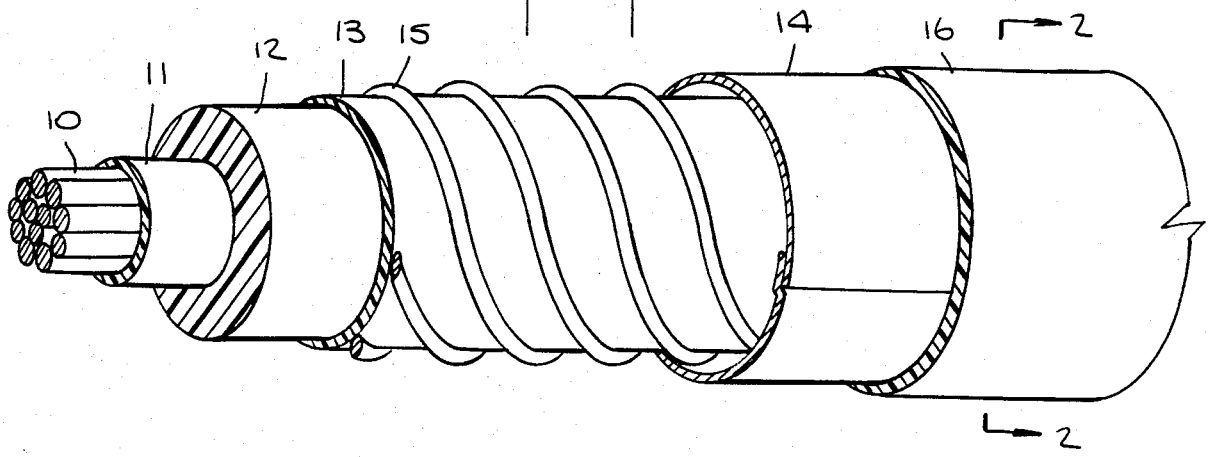
Fig. 2.
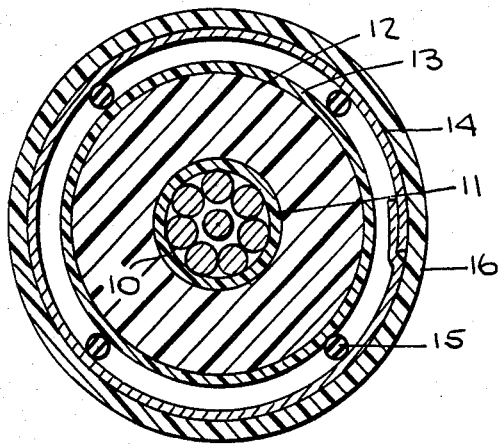
Fig. 4.
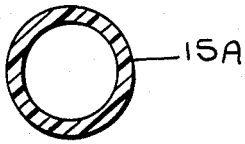
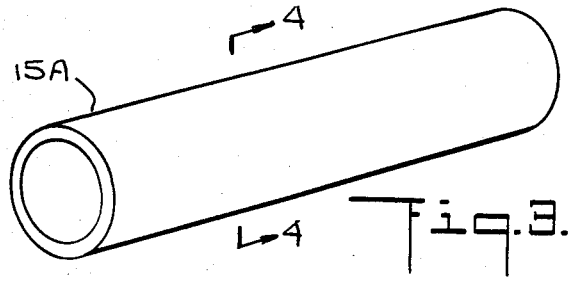
Fig. 3.
Fig. 12
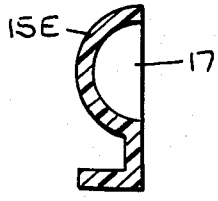
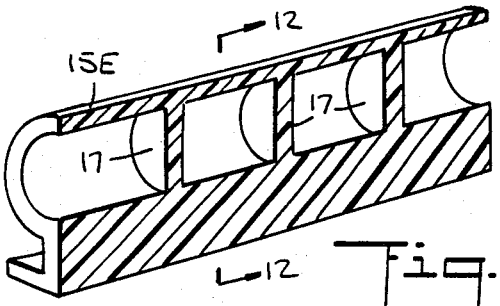
Fig. 11.

Fig. 6.
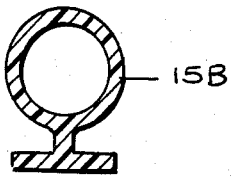
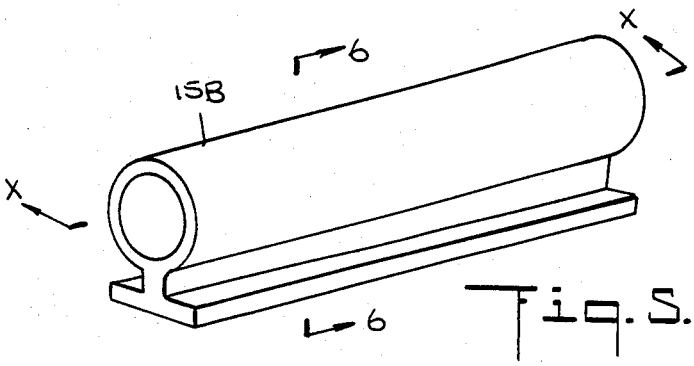
Fig. 5.
Fig. 8.
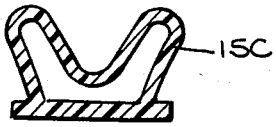
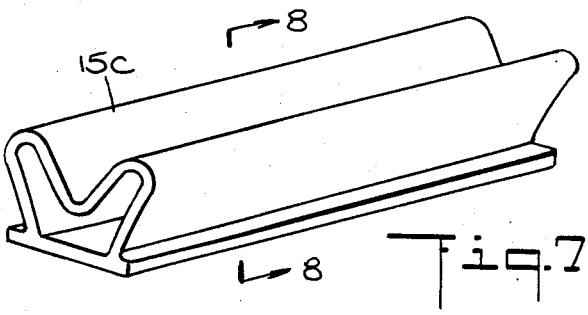
Fig. 7.
Fig. 10.
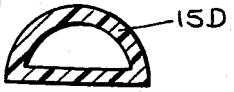
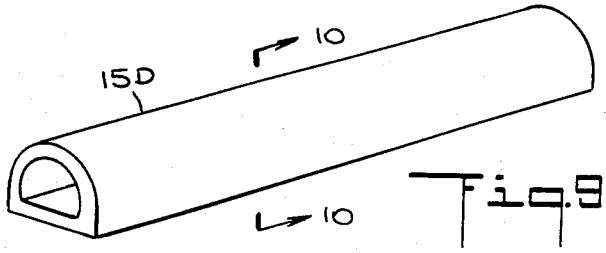
Fig. 9.
Fig. 14.
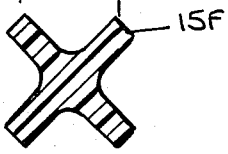
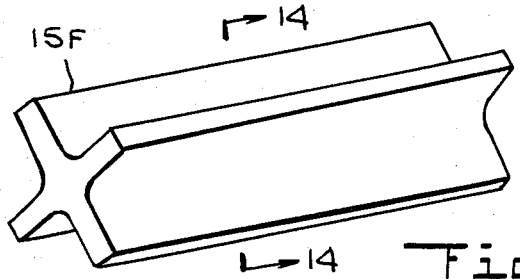
Fig. 13.

Fig. 16.
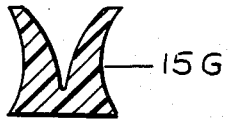
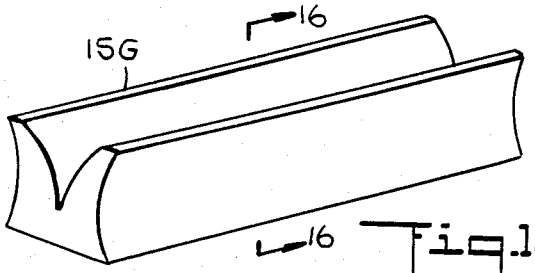
Fig. 15.
Fig. 18.
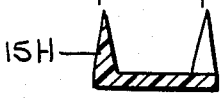
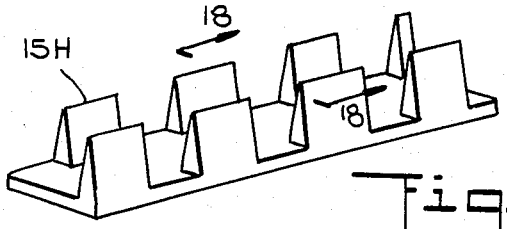
Fig. 17.
Fig. 20.
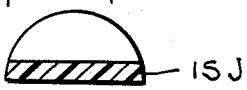
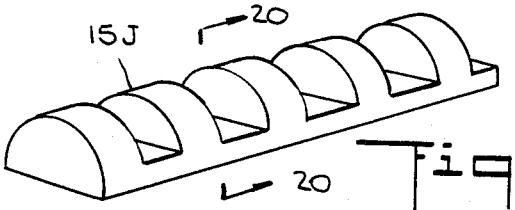
Fig. 19.
Fig. 22.
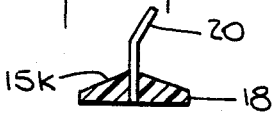
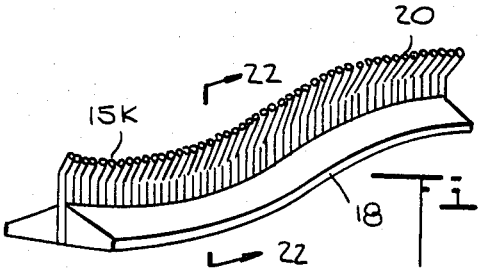
Fig. 21.
Fig. 24.
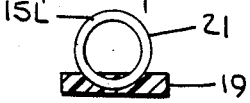
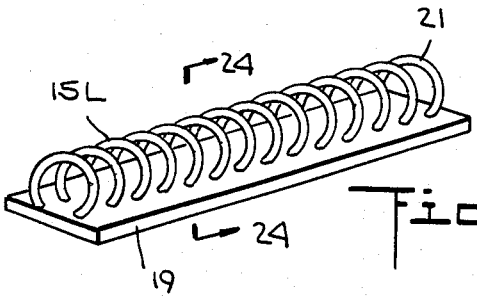
Fig. 23.

HIGH VOLTAGE ELECTRIC POWER CABLE WITH THERMAL EXPANSION ACCOMMODATION

This application is a continuation, of application Ser. No. 465,802, filed Feb. 11, 1983 now abandoned.

BACKGROUND OF THE INVENTION

The present invention relates to high voltage electric power cables and, more particularly, to those cables having thick polymeric insulation.

A typical high voltage cable has a centrally located electrical conductor that is covered by a semiconducting conductor shield to smooth out the electric field that accompanies current flow through the conductor. Over the semiconducting conductor shield is applied the insulation having a thickness dependent upon the voltage rating of the cable, the higher the voltage rating the thicker the insulation. Over the insulation another layer of semiconducting material is applied to provide a uniform equipotential electrically conducting surface. In order to provide sufficient fault current capacity, the last mentioned layer of semiconducting material is augmented by a metallic member which typically is made of copper or lead. Collectively, the metallic member and the last mentioned semiconducting layer comprise an insulation shield. The metallic member is often referred to as the metallic shield. Finally, over the metallic shield there is applied a protective jacket usually of polyethylene (PE), polyvinyl chloride (PVC) or other suitable material. The jacket provides mechanical and, to some extent, environmental protection to the cable core. The usual method for producing the semiconducting conductor shield layer, the thick wall insulation layer, and the jacket is extrusion; hence, this cable is often referred to as an extruded type cable.

In modern construction of extruded type high voltage power cables it is a requirement that moisture be kept away from the cable insulation. Environmental moisture diffusing into the cable insulation can promote the development, under electric stress, of harmful "electrochemical trees" which shorten the useful service life of the cable. These electrochemical trees will appear mainly at points where the electric stress is enhanced, i.e., at the location of conducting protrusions into the insulation or at the sites of contaminants therein. The shortening of the cable life can be very significant. For example, a cable which is intended to provide more than 40 years of useful service can start failing after only a few years of service. Because of this, it is of prime importance that environmental moisture surrounding the cable be kept away from the electrically stressed cable insulation. Heretofore, only hermetically sealed metal shields successfully excluded moisture from the cable core.

There are various techniques known for constructing the aforementioned outer insulation shield. The conductive element can, in known manner, take the form of: (a) copper wires applied in an open helix; (b) helically applied copper tapes or strips; (c) longitudinally applied, transversely corrugated, copper tapes having their edges overlapped; (d) lead sheaths and, occasionally, (e) relatively heavy extruded layers of corrugated aluminum or other metals. In the case of very small diameter low voltage cables, it is also known to employ flat longitudinally overlapped metal tapes.

Any helically applied metal tape, however, provides a passage for moisture between adjacent turns of the tape. Moreover, this type of shielding has application only in the lower voltage range of the high voltage cable art because it cannot accommodate the thermal expansion of the polymeric insulation system. Similarly, longitudinally applied and overlapped corrugated tapes permit passage of moisture through and along the overlap.

The use of flat longitudinally overlapped metal material in constructing the insulation shield has been restricted to construction of small diameter cables. When a cable is bent around a shipping reel the part of the cable facing the outside of the bend has to increase in length while the inside part of the cable has to compress. In a cable which has a relatively solid very smooth core, as is the case with most extruded polymeric cables, a metal shield wrapped in close contact with the core may not maintain its integrity, and bending the cable may result in severe deformation of the cable core or in deformation of the shield. In extreme cases, bending may even result in rupture of the shielding tape. Therefore, flat longitudinally overlapped metal tapes have, heretofore, been restricted to use in construction of small diameter cables bent over relatively large diameter drums where the inside and outside of the cable bend have only relatively small differences in length.

Previously, only extruded lead sheaths, extruded corrugated aluminum sheaths, or continuously welded stainless steel sheaths provided complete hermetic sealing of the cable core. Such sheaths, however, are extremely expensive to produce and increase significantly the cable cost. They may also be conducive to other difficulties as explained below.

When metal tapes either flat or corrugated are applied longitudinally over larger diameter cables, the overlap of the tapes must be left unsealed in order to allow for thermal expansion of the cable core. This is of extreme importance with higher voltage cables having thick insulation walls fabricated of dielectrics such as polyethylene and crosslinked polyethylene, materials that have excellent dielectric breakdown strength characteristics. In such cables, the thermal expansion of the insulation when the cables carry a significant amount of current or when they are installed in a relatively high temperature environment produces a significant increase in the wall thickness. In the case of crosslinked polyethylene (XLPE) the volume coefficient of thermal expansion is $1.25\times10^{-3}$ $cm^3/cm^3/°$ C. for the range 25–82° C. and $3.56\times10^{-3}$ $cm^3/cm^3/°$ C. for the range 83–125° C. Consequently, an increase in temperature from normal ambient of 25° C. to the emergency temperature rating of a cable, i.e., 130° C., will produce a significant increase in the thickness of the insulation system which increase will exceed 10% of the wall thickness. It should be noted that for an extruded cable the volumetric expansion is concentrated primarily in the radial direction.

The foregoing problem is particularly important with regard to cables having ratings of 15 KV or higher. Present 138 KV cables, for example, have an insulation thickness of 0.8 inches. Experimental 230 KV and higher rated cables having heavier insulations thicknesses are under development.

A number of attempts have been made in the past to solve the foregoing problem resulting from thermal expansion of the insulation. These attempts have made use of lead sheaths, longitudinally corrugated metallic shields, bedding materials such as semiconducting creped paper or a sponge type layer located between the extruded semiconducting layer and the metal tape. Also, longitudinally grooved or protruded extruded insulation shields have been proposed for this purpose.

Where lead sheaths have been used, the lead sheath expands together with the cable core, but the lead does not contract when the temperature of the cable core decreases. Consequently, the inner part of the insulation shield (semiconducting layer) separates from the outer part (lead) reducing the points of contact between the layers to a minimum and giving rise to a condition which could lead to extensive damage upon exposure to a fault condition.

The use of longitudinally corrugated metallic shields in high voltage cables is not very desirable either. Under thermal expansion conditions, severe deformation is induced into the cable insulation. In time, the outside of the cable core can acquire the shape of the corrugation and result in a nonuniform stress distribution along the cable length. In the case of longitudinally overlapped corrugated tape, although the metallic shield can change its radial dimensions, the thermal expansion of the core will produce a movement of the corrugated tape causing sliding of the overlapped edges. On numerous occasions this movement has resulted in longitudinal cracking of the outer jacket with the consequent penetration of environmental moisture into the cable core at the location of the crack.

Placing semiconducting creped cellulose paper or a sponge-like material between the extruded semiconducting insulation shield and the metallic shielding tapes, even though offering a temporary solution, is not a good solution. In time, and under repeated thermal expansion and contraction of the core, the creped paper or sponge-like material tends to flatten out and take a permanent set. In addition, semiconducting cellulose paper is highly hygroscopic and can become a moisture reservoir.

It has also been suggested to produce cables with insulation shields having fins or grooves, but the manufacture of such cables is limited to extrusion lines provided with curing sections having significantly larger diameter than the diameter of the cable core. Additionally, very sophisticated control of tension is required to avoid touching between the outer cable core surface and the surrounding enclosure while the composition material is still soft.

SUMMARY OF THE INVENTION

With the foregoing as background, the present invention has for its object to permit the construction of high voltage cables with ratings as high as 345 KV in which use can be made of hermetically sealed metallic shields of varied construction without having to be concerned about the problems discussed above. As will appear from the ensuing discussion, the invention permits the use of inexpensive metal shields without risk of failure due to change in circumferential dimensions of the cable as it is subjected to high temperatures.

In accordance with one aspect of the present invention there is provided a high voltage electric power cable adapted to withstand wide swings in temperature in which a thick layer of polymeric insulation material surrounds an electrically conductive core structure, and an insulation shield surrounds said layer of insulation material, characterized in that said insulation shield comprises an electrically conductive member having a smaller coefficient of thermal expansion than said polymeric insulation material, and means interposed between said conductive member and said polymeric layer including a structurally resiliently compressible substantially shape recoverable element for adapting to any change in the radial dimension of the space between said conductive member and said layer of insulation material while maintaining engagement with the radially inner surface of said conductive member.

BRIEF DESCRIPTION OF THE DRAWINGS

The invention will be better understood after reading the following detailed description of the presently preferred embodiments thereof with reference to the appended drawings in which:

FIG. 1 is a perspective view of a cable embodying the present invention with portions broken away to reveal the various layers of construction;

FIG. 2 is a transverse sectional view taken along line 2—2 in FIG. 1;

FIG. 3 is a perspective view of one embodiment of the compressible element incorporated in the cable of FIG. 1;

FIG. 4 is a transverse sectional view taken along line 4—4 in FIG. 3;

FIG. 5 is a perspective view of another embodiment of the compressible element representing a modification of the embodiment of FIG. 3;

FIG. 6 is a transverse sectional view taken along line 6—6 in FIG. 5;

FIGS. 7 and 9 are views similar to FIG. 3 showing further modifications employing hollow core construction;

FIGS. 8 and 10 are transverse sectional views taken along line 8—8 and 10—10 in FIGS. 7 and 9, respectively;

FIG. 11 is, in the first instance, a longitudinal sectional view taken along line X—X in FIG. 5 to show a modification of the embodiment of FIG. 5 with the addition of transverse webs; and FIG. 11 is also representative of a separate modified embodiment;

FIG. 12 is a transverse sectional view taken along line 12—12 in FIG. 11; and FIGS. 13 to 14 illustrate in similar fashion a series of further embodiments of the compressible element with each odd numbered Figure representing a transverse sectional view of the next lower numbered Figure.

The same reference numerals are used throughout the drawings to designate the same or similar parts.

DETAILED DESCRIPTION OF THE PREFERRED EMBODIMENTS

Referring initially to FIGS. 1 and 2, there is illustrated therein a typical cable construction embodying the present invention. As illustrated, the cable contains a bundle of conductive wires 10 forming an electrically conductive core structure. Surrounding the conductors 10 is a semiconducting conductor shield 11 over which is extruded the layer of insulation material 12 constituting the primary insulation for the cable. Surrounding the primary insulation 12 is an insulation shield consisting of a radially inner extruded semiconducting layer of semiconducting material 13 radially spaced from an outer metallic shield or member 14 between which is interposed a helically wrapped elongated strip 15 of compressible construction, the details of which will be described hereinafter. Outside of the metallic shield layer 14 is the protective jacket 16.

The subassembly of the cable consisting of the conductors 10, the semiconducting shield 11 and the primary insulation 12, along with the inner layer 13 of the insulation shield, can be constructed in any known manner by any of the methods described above by way of background information. The insulation layer 12 is preferably formed from either polyethylene or crosslinked polyethylene. Preferably, the shield layer 14 is formed from longitudinally overlapped metal sealed at the overlap by suitable cement, epoxy, fusion weld or other means.

FIGS. 3 through 24 illustrate a number of diverse shapes for the elongated element 15, all of which are susceptible of being wrapped around the cable core structure before application of metallic layer 14 and jacket 16. The various elements are distinguished by reference numerals 15A though 15H and 15J to 15L. All of the elements illustrated in FIGS. 3 to 24 have in common the ability to be wrapped around the cable in a continuous or intermittent pattern and to deform to fully absorb the radial change in dimensions of the cable core or sub-structure during thermal expansion without causing a significant change in the outer diameter of the metallic shield 14. The choice of crosssection and material for the various elements 15 should be such as to preclude reduction of the radial dimension of the element when in place in the cable to less than 10% of its original magnitude. Upon cooling of the cable permitting thermal contraction, the elements 15 must be capable of returning to their prior shape maintaining physical contact between the surface of the semiconducting layer 13 and the metallic layer 14 of the insulation shield.

Preferably, the compressible elements 15 are constructed of either electrically conductive materials or incorporate electrically conductive members in order to provide an electrically conductive path between the elements 13 and 14 of the insulation shield. The conductivity of the compressible elements should be at least 1 micromho per centimeter. When the elements are made of dielectric material the dielectric constant should be at least 4. Whether to use semiconducting or high dielectric constant material for the compressible elements depends on which of these materials has been used for the insulation shield. However, it is also possible to combine the use of a semiconducting shield with a high dielectric constant compressible member.

The elements 15 can be made of the same semiconducting, insulating or high dielectric constant materials as used in the cable core. Where insulating materials are used they can be made suitably semiconducting or conductive by the addition of appropriate semiconducting or conductive material to maintain the electric continuity between the extruded insulation shield 13 and the metallic shielding element 14. In the case of thermoset insulated cables, in order to withstand the high temperatures during emergency operation, the elongated elements 15 should also be made of a thermoset type material. However, when the other elements of the cable are generally thermoplastic in nature, the compressible elements 15 may also be thermoplastic.

As seen from the various embodiments shown in FIGS. 3 to 24, the elongated elements may be hollow, such as those illustrated in FIGS. 3 to 10. In order to avoid the passage of moisture or other fluid along the hollow elements, the elements may be compartmentalized. For example, the element shown in FIG. 5 can be modified by incorporating longitudinally spaced transversely disposed webs 17 as shown in FIGS. 11 and 12. Such webs will also modify the compressibility of the elongated element 15.

In order to provide a better grip or fit against the cylindrical underlying cable structure, the compressible elements 15 may be flat on one side such as shown in FIGS. 5 to 12 and 15 to 24. The X-shape cross-section of the element 15F shown in FIGS. 13 and 14, having spread legs or edges, will engage the underlying cylindrical surface of the cable in a manner similar to the flat surfaces shown in the other figures.

The FIGS. 11 and 12, besides illustrating a modification of the element 15B of FIGS. 5 and 6, also show a distinct element in their own right. That is, instead of FIG. 11 representing a one half section of FIG. 5, FIG. 11 can be considered, ignoring the cross-hatching, as showing a complete element wherein the webs 17 only serve to modify the compression characteristics of the element and are not included to bar the passage of moisture.

The embodiments shown in FIGS. 21 to 24 are composite in nature having a nonmetallic base portion 18 or 19 on which is mounted a metallic component 20 or 21, respectively. The metallic component should be of such nature that it will provide the requisite compressibility with suitable resiliency to function as the absorbing element and at the same time can be conveniently embedded in the nonmetallic base 18 or 19. The metallic element should be continuous throughout the length of the element in order to provide for electrical continuity. Thin narrow plates or wires made of phosphorous bronze have the good electrical conductivity and flexing characteristics required for use in the preferred embodiments.

The various elongated compressible elements shown in FIGS. 3 to 24 can be manufactured by any well-known method. While various of the embodiments are shown formed from plastic or other nonmetallic material, it is to be understood that metal may be substituted for the plastic in such configurations as that shown in FIG. 13 or FIG. 15, for example.

The conventional equipment utilized for applying shielding tapes over cable cores can be utilized either in its present form or slightly modified for the application of the compressible elements 15 over the cable insulation. The spacing between adjacent turns of the element 15 will be determined by the nature of the metallic shield layer 14 and the minimum cable bending radius. Two or more elements 15 can be applied in parallel, if desired.

Use of compressible elements as described in the present application permits the utilization in many cases of plain, flat metallic shields over relatively large diameter cores without the need for corrugating. Because the elements 15 will compress or deform under the action of forces produced either internally or externally of the cable, e.g., when the cable is bent, a flat metallic shield merely changes transverse shape. The metallic shield, i.e., the layer 14, may be made of plain copper or aluminum or from fused polymer-aluminum or similar material. If metal tapes are used they can be sealed longitudinally since no change in the overall circumferential dimension need take place radially outwardly of the element 15. Low cost moisture impervious shielding materials that can be bonded together by cement rather than by welding can be utilized by virtue of the present invention.

With the construction described above, if by accident the jacket and metallic shield were to be penetrated or punctured, moisture could enter and travel along the cable length following the channel between successive turns of the compressible element 15. To minimize the possibility of this happening, the space between the adjacent turns can be filled by any of a number of materials of known composition having highly absorbent characteristics. An example of such absorbent material, sometimes referred to as swelling powders, is a water absorbent polymer sold under the trade designation "SGP" 502S by General Mills Chemicals, Inc. of Minneapolis, Minn. Such swelling powders expand and swell to many times their original volume in the presence of water and thereby stop the flow of such water. Also, compressible foam like tapes could be used for this purpose.

Dimensions for the compressible element 15 are dictated by the cable core dependent upon the type insulation and thickness and by the characteristics of the element 15 as to its shape and material. For example, typical elements when used in a 138 KV cable having an insulation wall thickness of 0.8 inches would have a height between 0.1 inch and 0.15 inch and a width between 0.2 inch and 0.25 inch.

By way of summary, the present invention is embodied in a high voltage cable provided with one or more compressible or deformable elongated members wrapped helically around and over the extruded semiconducting shield in the same manner as shielding tapes have been wrapped helically over small cable cores. The compression or deformation of the helically applied elements avoids the change in radial dimension of the metal shield layer and, consequently, allows for the use of a large number of hermetic relatively thin metal shields such as inexpensive longitudinally overlapped metal shields which are not corrugated prior to their application and which can be sealed at their overlap by a relatively inexpensive cement, epoxy, weld or any other means.

Having described the present invention in terms of the presently preferred embodiments thereof, it should be understood by those skilled in the subject art that various changes in construction can be incorporated without departing from the true spirit of the invention as defined in the appended claims.

What is claimed is:

1. A high voltage electric power cable adapted to withstand wide swings in temperature in which a thick layer of polymeric insulation material surrounds an electrically conductive core structure, an insulation shield comprising an electrically conductive member having a smaller coefficient of thermal expansion than said polymeric insulation material surrounds said layer of insulation material, and compressible means are interposed between said conductive member and said polymeric layer, characterized in that said compressible means comprises a structurally resiliently compressible and substantially shape recoverable element for adapting to any change in the radial dimension of the space between said conductive member and said layer of insulation material throughout the entire circumference of the cable while maintaining engagement with the radially inner surface of said conductive member, and said compressible element is constructed from material having electrical conductivity of at least 1 micromho per centimeter.

2. A high voltage electric power cable according to claim 1, characterized in that said compressible element comprises an helically wrapped elongated element of essentially uniform compressibility throughout its length.

3. A high voltage electric power cable according to claim 2, characterized in that said elongated element is of hollow construction.

4. high voltage electric power cable according to claim 3, characterized in that said elongated element is formed with a flat longitudinal surface to facilitate wrapping about in contact with an underlying cylindrical surface.

5. A high voltage electric power cable according to claim 3. characterized in that said elongated element has its hollow interior subdivided by longitudinally spaced transversely disposed webs for barring the passage of fluid through said element.

6. A high voltage electric power cable according to claim 2, characterized in that said elongated element has an X-shape cross-section.

7. A high voltage electric power cable according to claim 2, characterized in that said elongated element has a portion with a flat longitudinal surface to facilitate wrapping about in contact with an underlying cylindrical surface, and a plurality of webs projecting substantially normal to said flat surface and all in the same direction therefrom.

8. A high voltage electric power cable adapted to withstand wide swings in temperature in which a thick layer of polymeric insulation material surrounds an electrically conductive core structure, an insulation shield comprising an electrically conductive member having a smaller coefficient of thermal expansion than said polymeric insulation material surrounds said layer of insulation material, and compressible means are interposed between said conductive member and said polymeric layer, characterized in that said compressible means comprises a structurally resiliently compressible and substantially shape recoverable element for adapting to any change in the radial dimension of the space between said conductive member and said layer of insulation material throughout the entire cicumference of the cable while maintaining engagement with the radially inner surface of said conductive member, and said compressible element is constructed from dielectric material having a dielectric constant of at least 4.

9. A high voltage electric power cable according to claim 8, characterized in that said compressible element comprises an helically wrapped elongated element of essentially uniform compressibility throughout its length.

10. A high voltage electric power cable according to claim 9, characterized in that said elongated element is of hollow construction.

11. A high voltage electric power cable according to claim 10, characterized in that said elongated element is formed with a flat longitudinal surface to facilitate wrapping about in contact with an underlying cylindrical surface.

12. A high voltage electric power cable according to claim 10, characterized in that said elongated element has its hollow interior subdivided by longitudinally spaced transversely disposed webs for barring the passage of fluid through said element.

13. A high voltage electric power cable according to claim 9, characterized in that said elongated element has an X-shaped cross-section.

14. A high voltage electric power cable according to claim 9, characterized in that said elongated element has a portion with a flat longitudinal surface to facilitate wrapping about in contact with an underlying cylindrical surface, and a plurality of webs projecting substantially normal to said flat surface and all in the same direction therefrom.

15. A high voltage electric power cable adapted to withstand wide swings in temperature in which a thick layer of polymeric insulation material surrounds an electrically conductive core structure, an insulation shield comprising an electrically conductive member having a smaller coefficient of thermal expansion than said polymeric insulation material surrounds said layer of insulation material, and compressible means are interposed between said conductive member and said polymeric layer, characterized in that said compressible means comprises a structurally resiliently compressible and substantially shape recoverable element for adapting to any change in the radial dimension of the space between said conductive member and said layer of insulation material throughout the entire circumference of the cable while maintaining engagement with the radially inner surface of said conductive member, and said compressible element consists essentially of an assembly of two structural components, one component being constructed from material having electrical conductivity of at least 1 micromho per centimeter, and the other component being constructed from dielectric material having a dielectric constant of at least 4.

16. A high voltage electric power cable according to claim 15, characterized in that said compressible element comprises an helically wrapped elongated element of essentially uniform compressibility throughout its length.

17. A high voltage electric power cable according to claim 16, characterized in that said elongated element is formed with a flat longitudinal surface to facilitate wrapping about in contact with an underlying cylindrical surface.

18. A high voltage electric power cable according to claim 16, characterized in that said elongated element comprises a first elongated strip of dielectric material with a flat longitudinal surface to facilitate wrapping about in contact with an underlying cylindrical surface, and a metallic spring-like component united with said strip on the side remote from said flat longitudinal surface and projecting away from said strip, said spring-like component being sufficiently yieldable and flexible to permit helical wrapping of said element with said flat longitudinal surface engaging an underlying cylindrical surface and to provide said resiliently compressible characteristic.

* * * * *